US006145833A

United States Patent [19]

Rodewald et al.

[11] Patent Number: 6,145,833

[45] Date of Patent: Nov. 14, 2000

[54] ROTARY BRUSH SHEET DECELERATION DEVICE

[75] Inventors: Dennis W. Rodewald; Andrew J. Ponomarenko, both of Phillips, Wis.

[73] Assignee: Marquip, Inc., Phillips, Wis.

[21] Appl. No.: 09/089,280

[22] Filed: Jun. 2, 1998

[51] Int. Cl.[7] ..... B65H 29/68

[52] U.S. Cl. ..... 271/182; 271/182; 271/202; 271/220

[58] Field of Search ..... 271/182, 202, 271/220

[56] References Cited

U.S. PATENT DOCUMENTS

| | | | |
|---|---|---|---|
| 3,815,899 | 6/1974 | Hatzmann | 271/80 |
| 3,869,117 | 3/1975 | Yoshimura | 271/270 |
| 3,998,141 | 12/1976 | Hsiue . | |
| 4,133,523 | 1/1979 | Berthelot . | |
| 4,428,574 | 1/1984 | Kataoka | 271/307 |
| 4,667,953 | 5/1987 | Hirakawa et al. | 271/280 |
| 4,824,092 | 4/1989 | Kriefall et al. | 271/183 |
| 4,966,521 | 10/1990 | Frye et al. | 414/788.8 |
| 4,988,087 | 1/1991 | Sardano et al. | 271/314 |
| 5,060,928 | 10/1991 | Vits | 271/182 |
| 5,186,450 | 2/1993 | Vits | 271/183 |
| 5,366,217 | 11/1994 | Tokuno et al. | 271/176 |
| 5,599,012 | 2/1997 | Rebeaud . | |
| 5,611,529 | 3/1997 | Richarz et al. | 271/183 |
| 5,950,510 | 9/1999 | Scheffer et al. | 83/23 |
| 5,957,050 | 9/1999 | Scheffer et al. | 101/227 |

FOREIGN PATENT DOCUMENTS

| | | | |
|---|---|---|---|
| 0408893 A1 | 1/1991 | European Pat. Off. | 271/182 |
| 59-92865 | 5/1984 | Japan | 271/182 |
| 61-140425 | 6/1986 | Japan | 271/220 |
| 61-178367 | 8/1986 | Japan | 271/220 |

*Primary Examiner*—Donald P. Walsh
*Assistant Examiner*—David A Jones
*Attorney, Agent, or Firm*—Andrus, Sceales, Starke & Sawall

[57] ABSTRACT

A rotary bristle brush, particularly adapted for use in a decelerating conveyor for shingling sheets, operates over a preload surface that subjects the moving bristles to an increasing bending deflection. The bristles are released from the preload surface just above the sheets entering the shingling conveyor to allow the ends of the preloaded bristles to spring downwardly into contact with the sheet. The contact force of the bristles helps drive the sheet downwardly onto the shingling conveyor which may be a vacuum conveyor.

9 Claims, 3 Drawing Sheets

ROTARY BRUSH SHEET DECELERATION DEVICE

BACKGROUND OF THE INVENTION

The present invention pertains to a sheet feeding or delivering device and, more particularly, to an improved rotary brush assembly for use in the deceleration section of a sheet conveying system.

Sheet conveying and handling systems often include a deceleration section where serially aligned sheets leaving an upstream conveyor are compressed and shingled on a slower moving downstream receiving conveyor. One common type of decelerating or shingling conveyor utilizes a vacuum belt which serves to capture the faster moving sheets from the upstream conveyor and hold them onto the vacuum belt of the slower moving deceleration conveyor. Depending upon sheet length, speed, and the material from which the sheets are made, a vacuum deceleration conveyor may alone be insufficient to provide adequate sheet deceleration and to maintain control of the sheet.

Various devices to assist the transfer of sheets onto a vacuum deceleration conveyor are known in the art. One common device is an arrangement of one or more brushes, each of which extends across the conveyor perpendicular to the direction of sheet travel and positioned to bring a line of flexible brush bristles into bearing contact with the upper surfaces of the sheets as they are delivered into the vacuum conveyor section. The brush or brushes assist in providing a frictional decelerating force to the sheets and also to press the sheets downwardly onto the vacuum conveyor because of the inherent resilience of the bristles. Such brush assemblies often include means for adjusting the angle and amount of bristle contact with the sheets to selectively vary the force imposed by the brushes.

Typical prior art sheet deceleration devices including brushes are shown in U.S. Pat. Nos. 3,998,141, 4,133,523, 4,667,953, and 5,599,012. Plastic fiber bristles are often used in such brushes, but little attention has been paid in the prior art to the particular selection of plastic resins from which such bristles are made. Bristles or strips made of polyurethane, nylon, neoprene and other common plastics are known, However, a characteristic common to all of these materials is that, in use and under load, whether constant or varying, prior art plastic bristles wear rapidly from contact with abrasive paper sheets and quickly take a permanent set reflecting the bend to which they are subjected in use. Both the reduction in bristle length because of wear and the effective change in bristle position because of a permanent set in the bristles change the performance of the brushes and eventually require readjustment of the brush positioning system or replacement of the brush.

In copending and commonly owned U.S. application Ser. No. 08/994,604, filed Dec. 19, 1997, the prior art problems of rapid bristle wear and permanent bristle deformation or set in brushes used in sheet handling systems is obviated by the use of pultruded fibers of certain selected kinds. The invention is particularly adapted for use in a sheet handling system to assist in serially decelerating sheets which are being conveyed in a line onto a conveyor operating at a speed less than that of the line. The system includes a series of laterally aligned parallel bristles which are attached at one end to a common holder. A mounting device supports the holder over the conveyor with the free ends of the bristles extending in a generally downward direction and operable to cause the free ends of the bristles to bear downwardly against the sheets with a force sufficient to bend the bristles.

The bristles have a pultruded construction which substantially resists the formation of a permanent set over a specified minimum bristle wear life.

SUMMARY OF THE INVENTION

In accordance with the present invention, a rotary bristle brush assembly is adapted for use in a decelerating or shingling conveyor for sheets. The brush may include bristles of a pultruded construction as described in the above identified copending application.

The rotary brush assembly of the present invention is used to assist in controlling sheets which are being serially conveyed in a line onto a shingling conveyor, preferably of the vacuum type, operating at a speed less than the speed of the incoming line of sheets. The brush assembly comprises a series of resilient bristles which are attached at one end to and extend radially from a shaft. The shaft is rotatably mounted over the conveyor such that the free ends of the bristles, when positioned to extend generally downwardly, bear downwardly against the sheets. A drive is provided to rotate the shaft and carry the bristles in the direction of sheet movement. The rotary brush cooperates with a stationary arcuate preload surface which is positioned above the sheets for engagement by the ends of the rotating bristles. Engagement of the bristles with the preload surface causes the bristles to bend and, when rotated past the surface, to spring downwardly into contact with a sheet entering the shingling conveyor.

By utilizing bristles of a pultruded construction, the formation of a permanent set from bending is resisted and bristle wear life substantially extended.

The arcuate preload surface is curved in the direction of rotation of the shaft in a manner to approach the shaft axis. The arcuate surface may comprise a cylindrical surface portion of circular curvature. Alternately, the surface may comprise a surface portion of compound curvature of decreasing radius in the direction of shaft rotation.

The shaft mounting device may be adjustable to change the position of the brush vertically with respect to the conveyor and the sheets carried thereon. The preload surface may also be adjustable relative to the brush to vary the amount of bending imposed on the bristles. Preferably, the drive is operable to move the free ends of the bristles faster than the line speed of the sheets.

In an alternate embodiment, the bristles are attached to the shaft to form a cylindrical sector of bristles. In this embodiment, the drive is operable to bring the sector of bristles into contact with the tail end of the sheet.

DETAILED DESCRIPTION OF THE PREFERRED EMBODIMENTS

Figure 1:
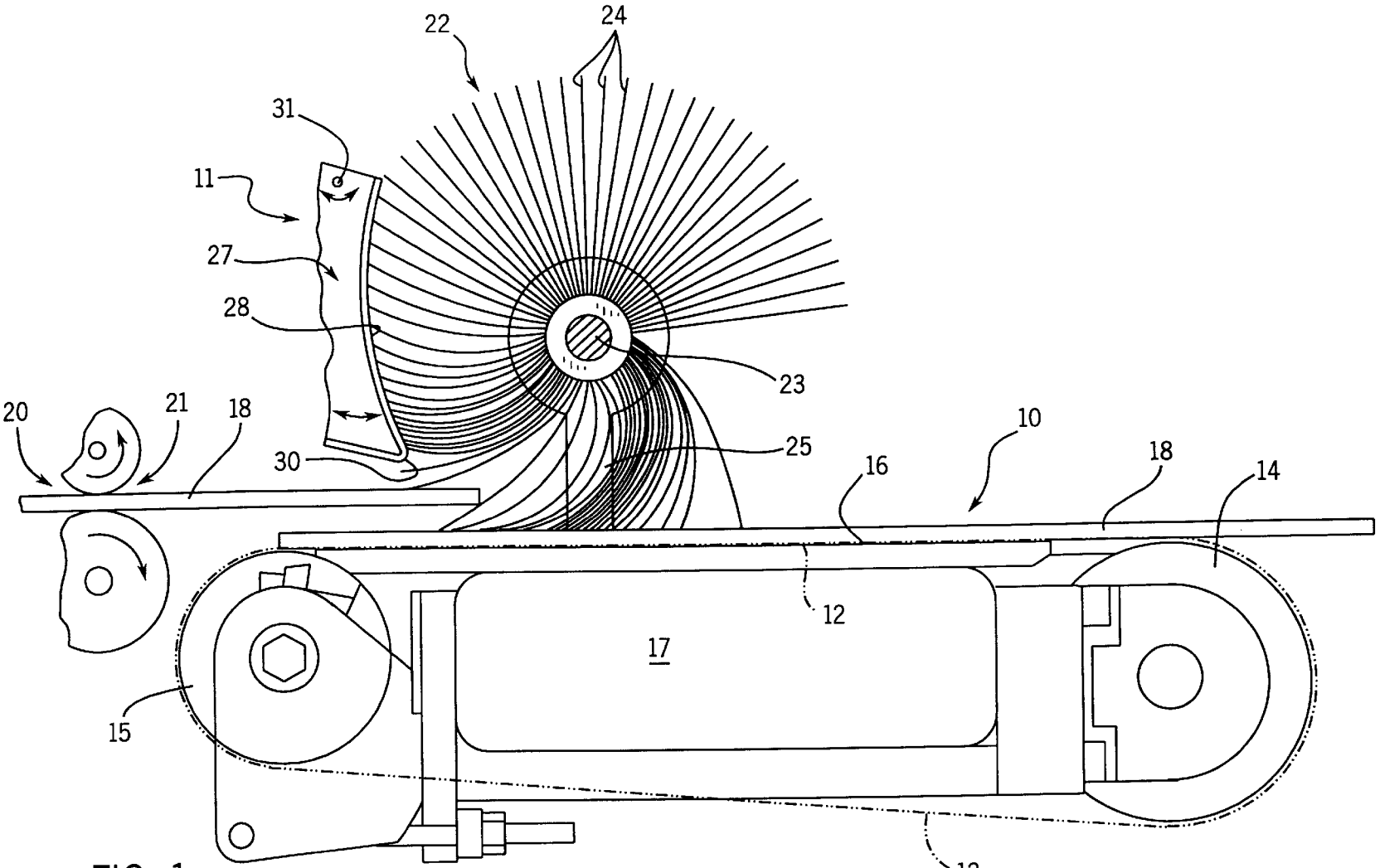
FIG. 1 is side elevation view, taken on line 1—1 of FIG. 2, of a vacuum decelerating conveyor utilizing a rotary brush of the present invention.
Figure 2:
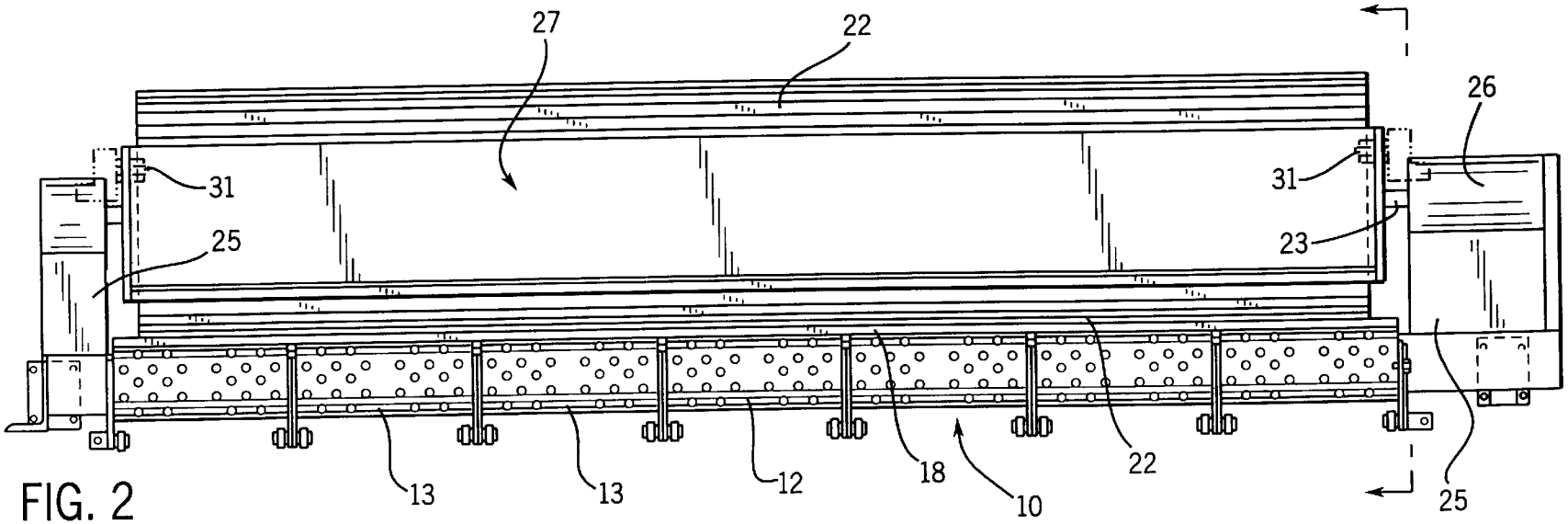
FIG. 2 is vertical elevation of the assembly shown in FIG. 1 viewed in the downstream direction.

A sheet deceleration system includes a vacuum conveyor 10 over which is suspended a rotary brush assembly 11 of the present invention. The vacuum conveyor 10 includes a driven apertured belt 12 comprising a series of laterally adjacent belt sections 13. The belt sections operate around a common downstream driven head pulley 14 and a common upstream tail pulley 15. The upper conveying run 16 of the belt is supported on a vacuum plenum 17. A vacuum applied by the plenum 17 is transmitted through the conveying run 16 of the apertured belt 12 causing a paper or paperboard sheet 18 to be drawn down onto the conveying run and held thereon to move at vacuum belt speed.

Typically, the sheets 18 are delivered to the vacuum conveyor 10 from an upstream conveyor 20, on which the sheets are serially arranged and, usually, in closely spaced relation. Because the vacuum conveyor 10 is used to decelerate the stream of sheets, the line of sheets must be compressed on the vacuum conveyor and the result is an overlapping or shingling of the sheets, all in a known manner. As is also typical in the prior art, the exit nip 21 of the upstream conveyor 20 is elevated above the conveying run 16 of the vacuum conveyor 10. Thus, sheets delivered to the vacuum conveyor drop and are pulled down onto the vacuum belt, allowing the lead edge of the next following sheet (which is still traveling at the higher speed of the upstream conveyor 20) to overlap the trailing edge of the sheet captured on the vacuum conveyor without interference or obstruction.

The shingling process described above is assisted by use of the rotary brush assembly 11 of the present invention. A rotary brush 22 of generally cylindrical shape is supported on a shaft 23. The brush 22 comprises an array of long bristles 24 which may be constructed of a material and attached to the shaft at a spacing similar to that described in the above identified copending and commonly owned application Ser. No. 08/994,604, the subject matter of which is incorporated by reference herein. The brush 22 may be of unitary construction or may be made up of a series of narrow disk-like brush segments mounted in side-by-side position along the shaft 23. If disk-like brush segments are utilized, they may be, for example, about 1 inch (25 mm) thick in the axial direction and spaced from one another by about 3 inches (about 75 mm). A cylindrical brush construction of a type known in the art may also be utilized wherein narrow flexible brush-carrying strips are spirally wound on a shaft to form the brush.

The ends of the shaft 23 are rotatably journaled in shaft supports 25 on opposite lateral sides of the conveyor 10. The shaft is connected to a suitable drive 26 to rotate the brush in the direction of the incoming sheets 18 (or in a counterclockwise direction as viewed in FIG. 1). The shaft supports 25 are preferably adjustable vertically to vary the position of the brush. Preferably, the vertical position of the shaft 23 is set so that the bristles at the lower surface of the rotating brush remain in engagement with the sheet 18 when it is fully in contact with the belt 12 of the vacuum conveyor 10.

An additional and significant aspect of the brush assembly 11 of the present invention is a bristle preload surface 27 which imparts a bending deflection to the bristles 24 just above the incoming sheets 18. The preload surface 27 terminates above the line of sheets so that the bent and preloaded bristles are released as they move past the preload surface, allowing the ends of the bristles to spring downwardly into contact with a sheet. Bristle contact with the sheet helps push the sheet downwardly onto the surface of the vacuum conveyor 10.

The preload surface 27 preferably comprises a smooth curved surface portion 28 which extends axially the full length of the brush 22 and belt 12. The curved surface portion 28 is positioned or shaped to lie increasingly more closely spaced from the axis of rotation of the brush shaft 23 in the direction of brush rotation. Thus, as may be seen with reference to FIG. 1, the bristles 24 moving over the surface portion 28 are subjected to an increasing bending as they move toward the downstream end 30 of the surface. As the bristles pass the downstream end 30, the bending preload imparted to them causes the bristles to spring downwardly into contact with the upper surface of a sheet 18, helping to drive the sheet downwardly onto the vacuum conveyor 10.

The curved surface portion 28 may comprise a simple cylindrical surface portion (having a circular curvature). To provide a progressively increasing bending and preload with passage of the bristles thereover, a cylindrical curved surface portion will be oriented with its axis of curvature parallel to the shaft axis, but positioned vertically above it. In other words, the downstream end 30 defines the portion of the curved surface closest to the axis of the shaft 23. The preload surface 27 may alternately include a curved surface portion of compound curvature, where the radius of curvature of the surface decreases in the direction of brush rotation.

The preload surface 27 may be adjustably mounted to move the curved surface portion 28 generally horizontally (as shown by the double headed arrow in FIG. 1) to increase or decrease the amount of preload bending imposed on the bristles. One simple means of effecting such adjustable movement of the preload surface 27 is to pivotally mount the upper end of the surface on a pivot 31 for adjustable rotation in either direction.

The brush drive 26 may be a variable speed drive, but is preferably operable to rotate the brush 22 such that the free ends of the bristles 24 move at a speed faster than the line speed of the sheets 18. An additional benefit of bristle tip overspeed is that it allows the brush to sweep "loose back" (which tends to roll-up or fold back on the board) down onto the board surface. This helps prevent snagging of loose back and consequent jamming. However, the brush may also be operated at the same speed as the sheets or even at a lower speed.

Figure 3:
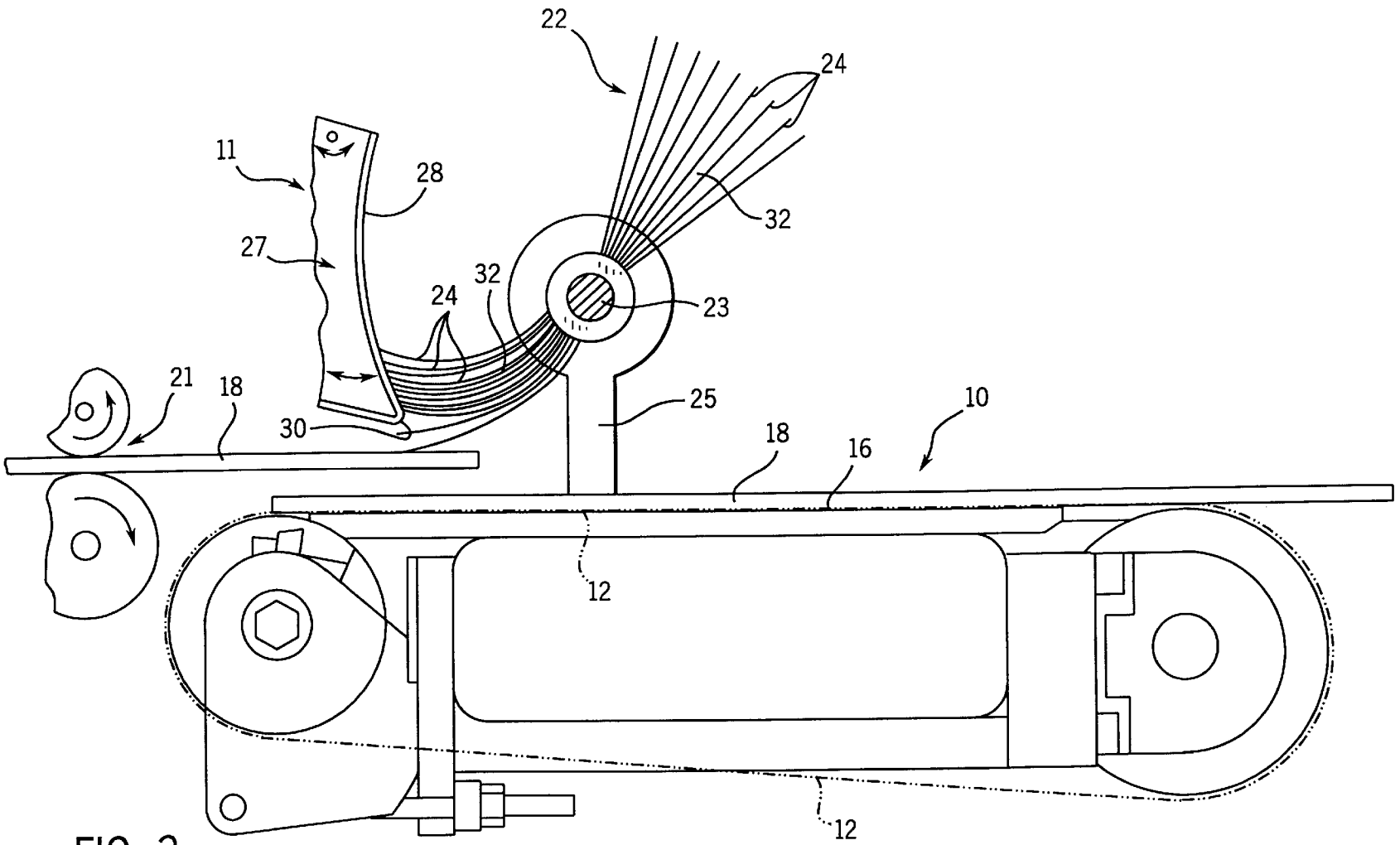
FIG. 3 is a side elevation similar to FIG. 1 showing a modified rotary brush.

In an alternate embodiment, the bristles 24 may be attached to the shaft to form less than a fall cylindrical brush. For example, the bristles may be attached to form a cylindrical sector 32, as shown in FIG. 3. The drive 26 may be timed to synchronize movement of the cylindrical sector 32 past the downstream end 30 of the preload surface to bring the bristles into contact with the tail end of the sheet 18 just as it leaves the exit nip 21 of the upstream conveyor 20. The brush may be provided with two such cylindrical sectors 32 mounted on diametrically opposite sides of the shaft for balance.

We claim:

1. A rotary brush assembly for use in a sheet handling system to assist in serially decelerating sheets being conveyed in a line onto a conveyor operating at a speed less than the speed of the line, said brush assembly comprising:

a series of resilient bristles attached at one end to and extending radially from a shaft;

a mounting device rotatably supporting the shaft over the conveyor with the free ends of the bristles, when positioned to extend downwardly, bearing downwardly against the sheets;

an arcuate preload surface curved in the direction of rotation of the shaft to approach the shaft axis, said preload surface positioned above the sheets for engagement by the ends of the rotating bristles to cause the bristles to bend and, when rotated past the device, to spring downwardly into contact with a sheet, and a drive for rotating the shaft to carry the bristles in the direction of sheet movement and into engagement with the sheets.

2. A rotary brush assembly for use in a sheet handling system to assist in serially decelerating sheets being conveyed in a line onto a conveyor operating at a speed less than the speed of the line, said brush assembly comprising:

a series of resilient bristles attached at one end to and extending radially from a shaft;

a mounting device rotatably supporting the shaft over the conveyor with the free ends of the bristles when positioned to extend downwardly, bearing downwardly against the sheets;

a drive for rotating the shaft to carry the bristles in the direction of sheet movement; and, a stationary preload surface positioned above the sheets for engagement by the ends of the rotating bristles to cause the bristle to bend and, when rotated past the surface, to spring downwardly into contact with a sheet, said preload surface having an arcuate shape curved in the direction of rotation of the shaft to approach the shaft axis.

3. The apparatus as set forth in claim 2 wherein said bristles have a pultruded construction which substantially resists the formation of a permanent set from said bending over a minimum bristle wear life.

4. The apparatus as set forth in claim 2 wherein said surface comprises a cylindrical surface portion of circular curvature.

5. The apparatus as set forth in claim 2 wherein said surface comprises a surface portion of compound curvature of decreasing radius in the direction of shaft rotation.

6. The apparatus as set forth in claim 2 wherein said mounting device is adjustable to change the position of the brush vertically with respect to the conveyor.

7. The apparatus as set forth in claim 2 wherein said preload surface is adjustable reactive to said brush.

8. The apparatus as set forth in claim 2 wherein said drive is operable to move the free ends of the bristles faster than the line speed of the sheets.

9. The apparatus as set forth in claim 2 wherein said bristles are attached to form a cylindrical sector, and said drive is operable to bring the sector of bristles into contact with the tail end of the sheet.

* * * * *